US012678679B2

(12) United States Patent
Campbell

(10) Patent No.: US 12,678,679 B2
(45) Date of Patent: Jul. 14, 2026

(54) BASKETBALL PRACTICE DEVICE AND METHOD

(71) Applicant: Thester Campbell, Allen, TX (US)

(72) Inventor: Thester Campbell, Allen, TX (US)

( * ) Notice: Subject to any disclaimer, the term of this patent is extended or adjusted under 35 U.S.C. 154(b) by 0 days.

(21) Appl. No.: 18/088,719

(22) Filed: Dec. 26, 2022

(65) Prior Publication Data

US 2023/0201686 A1 Jun. 29, 2023

Related U.S. Application Data

(60) Provisional application No. 63/294,045, filed on Dec. 27, 2021.

(51) Int. Cl.
*A63B 69/00* (2006.01)

(52) U.S. Cl.
CPC ..... *A63B 69/0071* (2013.01); *A63B 2214/00* (2020.08); *A63B 2225/093* (2013.01)

(58) Field of Classification Search
CPC ..... A63B 69/0071; A63B 2214/00; A63B 2225/093; A63B 63/083; A63B 2210/50; A63B 2225/09; A63B 2220/13
USPC ..... 473/447
See application file for complete search history.

(56) References Cited

U.S. PATENT DOCUMENTS 2,167,195 A * 7/1939 Ash ..... A47G 23/03 428/44
3,415,524 A * 12/1968 Vickers ..... A63B 69/3608 473/214
3,428,312 A * 2/1969 Machen ..... A63B 21/4015 482/130
3,507,402 A * 4/1970 Barbee ..... A47F 7/24 280/35
3,690,655 A * 9/1972 Chapman ..... A63B 23/14 482/109
3,735,988 A * 5/1973 Palmer ..... A63B 67/02 428/17
4,620,701 A * 11/1986 Mojden ..... A63B 3/00 482/142
5,042,815 A * 8/1991 Sutton ..... A63B 69/3667 473/218
5,213,323 A * 5/1993 Novinsky ..... A63B 69/0002 473/497
5,221,089 A * 6/1993 Barrett ..... A63B 69/0059 473/409
5,334,028 A * 8/1994 Melligan ..... A63B 69/3608 473/409

(Continued)

OTHER PUBLICATIONS

"Spalding NBA Universal Shot Trainer", www.ballsports.com.au, printed on Dec. 26, 2022, 2 pages.

(Continued)

*Primary Examiner* — John E Simms, Jr.
*Assistant Examiner* — Amir A Klayman
(74) *Attorney, Agent, or Firm* — Johnston IP Law, PLLC

(57) ABSTRACT

A basketball practice device for training a player to shoot with hir or her arms up includes a base member. The basketball practice device also includes a vertical member coupled to the base member. The vertical member has a lower end coupled to the base and an upper end. The basketball practice device further includes a horizontal member coupled to the upper end of the vertical member. Vertical guideposts may be coupled to the horizontal member.

1 Claim, 18 Drawing Sheets

(56) References Cited

U.S. PATENT DOCUMENTS 5,485,993 A * 1/1996 Lipsett ..... A63B 69/0071 473/448
5,685,107 A * 11/1997 Sweet ..... A01K 97/10 43/21.2
5,800,291 A * 9/1998 Grover ..... A63B 69/0071 473/422
5,833,081 A * 11/1998 Smith ..... B60R 7/10 224/313
6,001,026 A * 12/1999 Breneman ..... A63B 69/3623 473/278
6,135,895 A * 10/2000 Estivo ..... A63B 69/3661 473/278
6,159,111 A * 12/2000 Purcell ..... A63B 69/0071 473/472
6,217,483 B1 * 4/2001 Kallassy ..... A63B 21/068 482/41
6,544,132 B1 4/2003 Tvedt
6,843,730 B1 * 1/2005 Bellagamba ..... A63B 69/0057 473/215
7,431,661 B1 * 10/2008 Cailey ..... A63B 69/0057 473/262
7,434,772 B1 * 10/2008 Jou ..... A45D 20/14 248/124.2
8,303,430 B2 * 11/2012 Li ..... A63B 69/3661 473/278
8,366,590 B2 * 2/2013 Atnafe ..... A63B 22/0058 482/52
8,727,902 B2 * 5/2014 Shipman ..... A63B 69/3676 473/268
8,782,989 B2 * 7/2014 Tang ..... E04F 15/087 52/592.1
8,784,229 B1 * 7/2014 Mccullough ..... A63B 69/3676 473/266
9,011,263 B2 * 4/2015 Brown ..... A63B 57/0006 473/132
9,119,986 B2 * 9/2015 Colby ..... A63B 21/008
9,282,732 B2 * 3/2016 Henry, Jr. ..... A01K 97/10
10,252,131 B2 * 4/2019 May, II ..... A63B 69/0057
10,391,011 B2 * 8/2019 Miller ..... A61G 7/1038
11,000,748 B1 * 5/2021 Krystosek ..... A63B 69/0002
11,198,030 B2 * 12/2021 Endelman ..... A63B 21/0557
11,213,731 B1 * 1/2022 Anderson ..... A63B 63/004
11,918,858 B2 * 3/2024 Agrawal ..... A63B 71/0054
2002/0165037 A1 * 11/2002 Stitz ..... A63B 69/3608 473/260
2003/0089830 A1 * 5/2003 Loughman ..... F16M 11/10 248/125.7
2004/0077436 A1 * 4/2004 Goucher ..... A63B 71/023 473/451
2007/0042829 A1 * 2/2007 Dennesen ..... A63B 69/3661 473/162
2013/0040765 A1 * 2/2013 Myles ..... A63B 69/0071 473/447
2014/0171229 A1 * 6/2014 Klunick ..... A63B 69/0057 473/422
2015/0102187 A1 * 4/2015 Hennessey ..... F16M 11/10 403/103
2015/0165294 A1 * 6/2015 Wackerly ..... G09B 19/0038 473/448
2015/0231470 A1 * 8/2015 Kanner ..... A63B 69/0075 473/417
2015/0328518 A1 * 11/2015 Sagle ..... A63B 69/0071 473/447
2016/0067575 A1 * 3/2016 Choate ..... A63B 69/0002 473/451
2017/0282041 A1 * 10/2017 Chiles ..... G09B 19/0038
2018/0140924 A1 * 5/2018 Kent ..... A63B 69/36
2019/0344141 A1 11/2019 Falbo

OTHER PUBLICATIONS

International Search Report and Written Opinion received in Patent Cooperation Treaty Application No. PCT/US2022/054037, dated Mar. 21, 2023.

* cited by examiner

BASKETBALL PRACTICE DEVICE AND METHOD

CROSS-REFERENCE TO RELATED APPLICATION

This application claims the benefit of U.S. Provisional Application Ser. No. 63/294,045, filed by Thester Campbell, on Dec. 27, 2022, entitled "Basketball Practice Device and Method," which is incorporated herein by reference in its entirety for all purposes.

TECHNICAL FIELD

This application is directed, in general, to basketball practice devices and methods, and in particular to basketball practice devices to assist a user in keeping his or her arms raised while shooting.

BACKGROUND

The following discussion of the background is intended to facilitate an understanding of the present disclosure only. It should be appreciated that the discussion is not an acknowledgement or admission that any of the material referred to was part of the common general knowledge at the priority date of the application.

During basketball competitions the player shooting has to deal with defensive players that are in their face and trying to block their shots. The shooter often does better in terms of efficiency if they learn to shoot with their hands higher than chest level. This is a challenge for many basketball players who have learned early to push the ball from the chest level rather than placing it above their heads.

SUMMARY

According to an illustrative embodiment, a basketball practice device includes a base member, which when in an assembled position, is supported by a floor surface or ground. The basketball practice device also includes a vertical member coupled to the base and which extends vertically at least three feet. The vertical member has a lower end coupled to the base and an upper end. The basketball practice device further includes a horizontal member coupled to the upper end of the vertical member. The horizontal member is at least two feet long. In this way, a person practicing their basketball shot will have to practice with their arms above the horizontal member when standing next to the basketball practice device.

According to another illustrative embodiment, a basketball practice device includes a base member having a first side and a second side. The first side is for receiving at least one foot of a user, and the second side, which is opposes the first side, interfaces with a floor surface or ground. The basketball practice device also includes a mounting prong coupled to the first side of the base and a first vertical tube having a first open end and a second open end. The second open end is sized and configured to mate with the mounting prong. The basketball practice device further includes a first telescoping member having a first end and a second end. The second end of the first telescoping member is received by the first open end of the first vertical tube. A first fastening means proximate the first open end of the first vertical tube selectively secures the second end of the first telescoping member relative to the first vertical tube. The basketball practice device also has a first T-joint member coupled to the first end of the first telescoping member with a top of a "T" shape being most vertical and a horizontal member having a first end and a second end. The T-joint is coupled to between the ends of the horizontal member.

According to another illustrative embodiments, a basketball practice kit includes a basketball practice device and a rim target tape for applying to a basketball rim. Other embodiments are presented below.

DESCRIPTION OF THE DRAWINGS

Illustrative embodiments of the present invention are described in detail below with reference to the attached drawing figures, which are incorporated by reference herein and wherein.

DETAILED DESCRIPTION

In the following detailed description of the preferred embodiments, reference is made to the accompanying drawings that form a part hereof, and in which is shown, by way of illustration, specific embodiments in which the invention may be practiced. These embodiments are described in sufficient detail to enable those skilled in the art to practice the invention, and it is understood that other embodiments may be utilized, and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the claims. Unless otherwise indicated, as used throughout this document, "or" does not require mutual exclusivity.

According to an illustrative embodiment of the invention, a basketball practice device is provided that has a platform, or base, that goes on the ground with a securing member, e.g., a mounting prong, that secures a telescoping or adjustable, vertical member. The vertical member can be adjusted according to the height of the basketball player. The vertical member couples to a horizontal member that is orthogonal to the vertical member. In some embodiments, the coupling is a releasable coupling. On the horizontal member may be two optional, vertical posts that can be positioned along the horizontal member to a desired width-usually just wider than the shoulders of the basketball player, or user.

In use, the horizontal member is raised using the adjustability of the vertical member to a height where the basketball player has to have his or her elbows up around head height. By forcing the basketball player to keep his or her elbows above the horizontal member, it helps him or her to learn to shoot with their arms over their head.

In one embodiment, the telescoping member is a pipe or tube that slides onto a receiving end of a prong or securing member on the platform. It can have a slot with a wing screw for tightening in order to position a telescoping member inside the vertical member to adjust the height. In one illustrative embodiment, the vertical posts on the horizontal member may snap on or be attached with a clamp or fasteners. In one illustrative embodiment, the vertical member and horizontal member are made of PVC pipe. In one illustrative embodiment, the platform at the bottom is formed in multiple pieces that can be assembled such as with overlapping ledges. There are many variations and permutations that may be made as one skilled in the art will understand.

Figure 1:
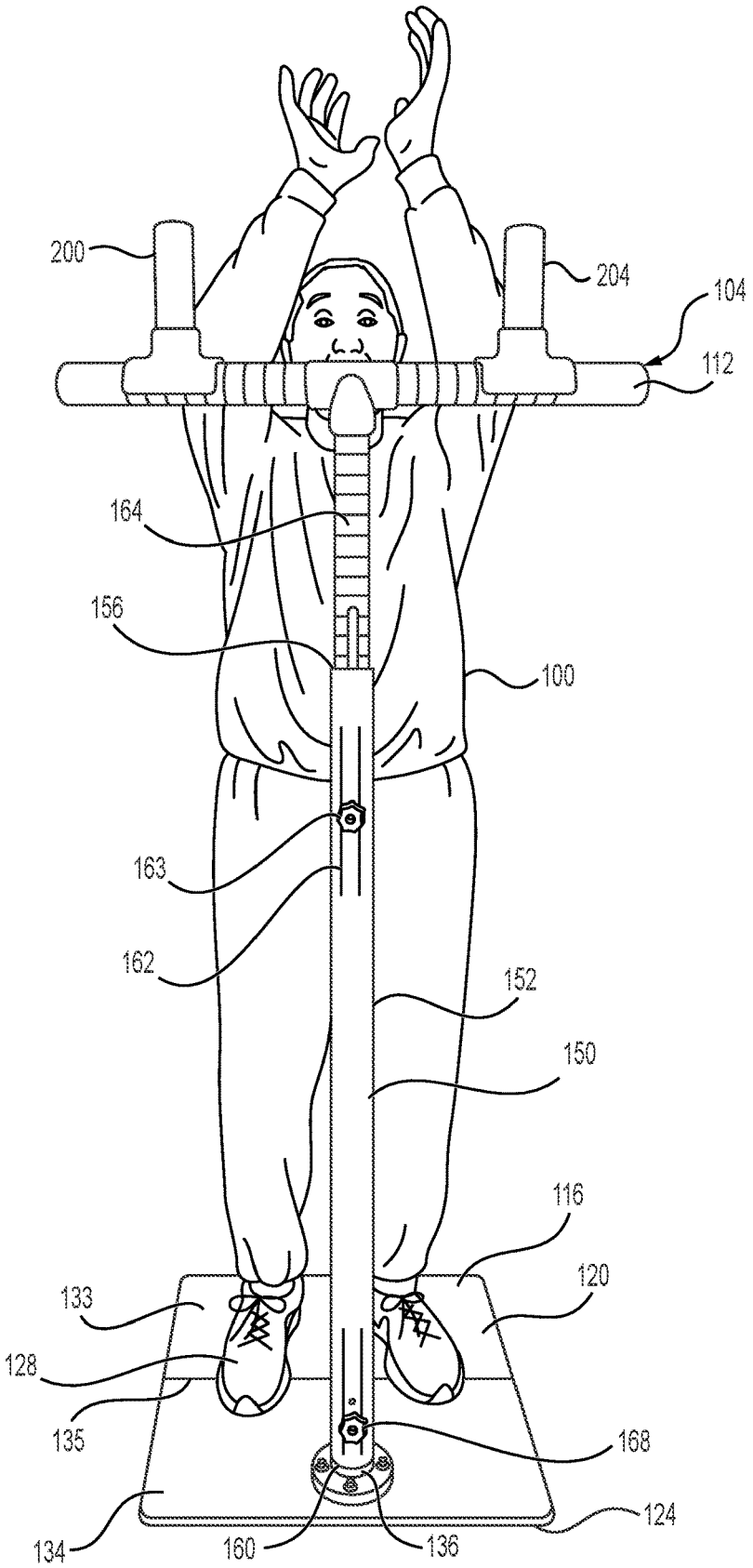
FIG. 1 is a front, schematic perspective view of a person using an illustrative embodiment of a basketball practice device.
Figure 2:
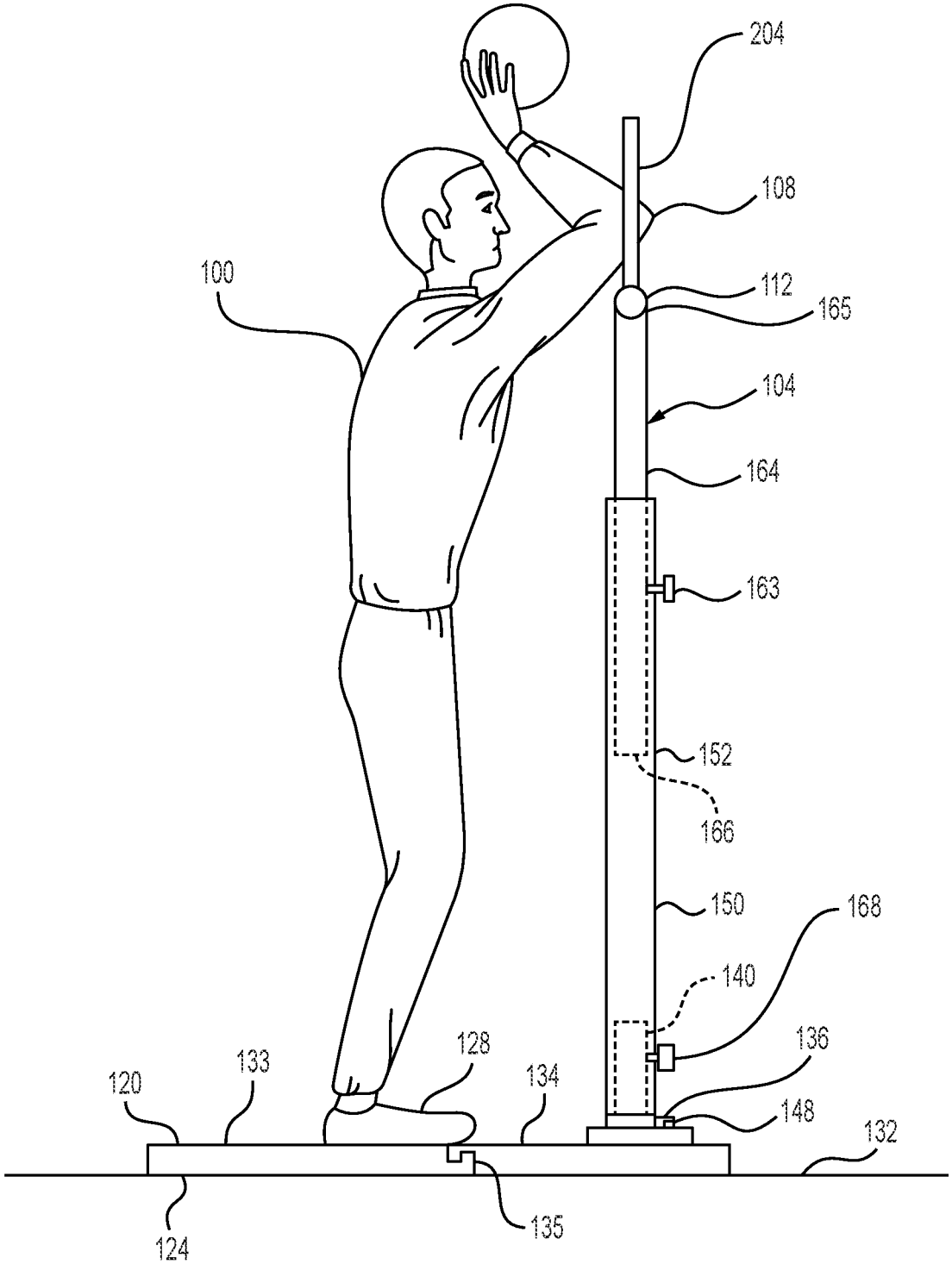
FIG. 2 is a side, schematic perspective view of a person using an illustrative embodiment of a basketball practice device.

Referring now to the figures, and initially to FIGS. 1 and 2, a basketball player 100 is shown using an illustrative embodiment of a basketball practice device 104. The basketball practice device 104 forces the player 100 to keep his or her elbows 108 above a horizontal member 112. This helps the player 100 learn to shoot with their arms above their head or near that position.

Figure 3:
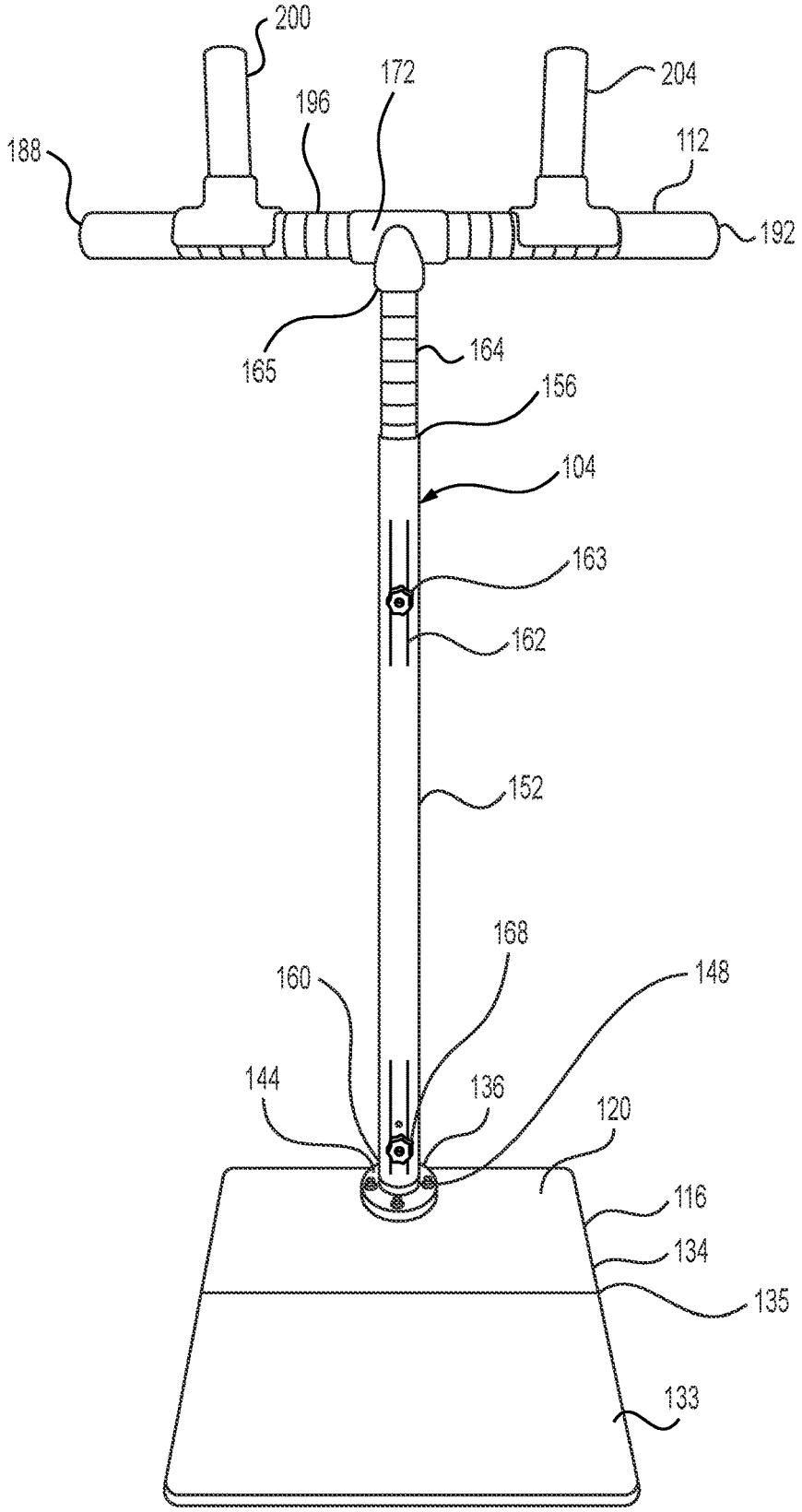
FIG. 3 is a front, schematic perspective view of an illustrative embodiment of a basketball practice device.

Referring now primarily to FIGS. 1-3, the basketball practice device 104 includes a base member 116 having a first side 120 and a second side 124. The first side 120 is for receiving at least one foot 128 of a user 100. The second side 124, which opposes the first side 120, interfaces with a floor surface 132 or ground. The base member 116 may be formed in a plurality of panels, e.g., first panel 133 and second panel 134, with a securing means, e.g., engaging ridges 135 used to couple them. The engaging ridges 135 (e.g., a first engaging ridge and a second engaging ridge) can be seen to overlap vertically and to complement each other in forming a coupling. The panels 133, 134 may be coupled in other ways, e.g., latches, hook-and-loop fasteners, inserted together, snapped together or formed as one solid piece.

Figure 4:
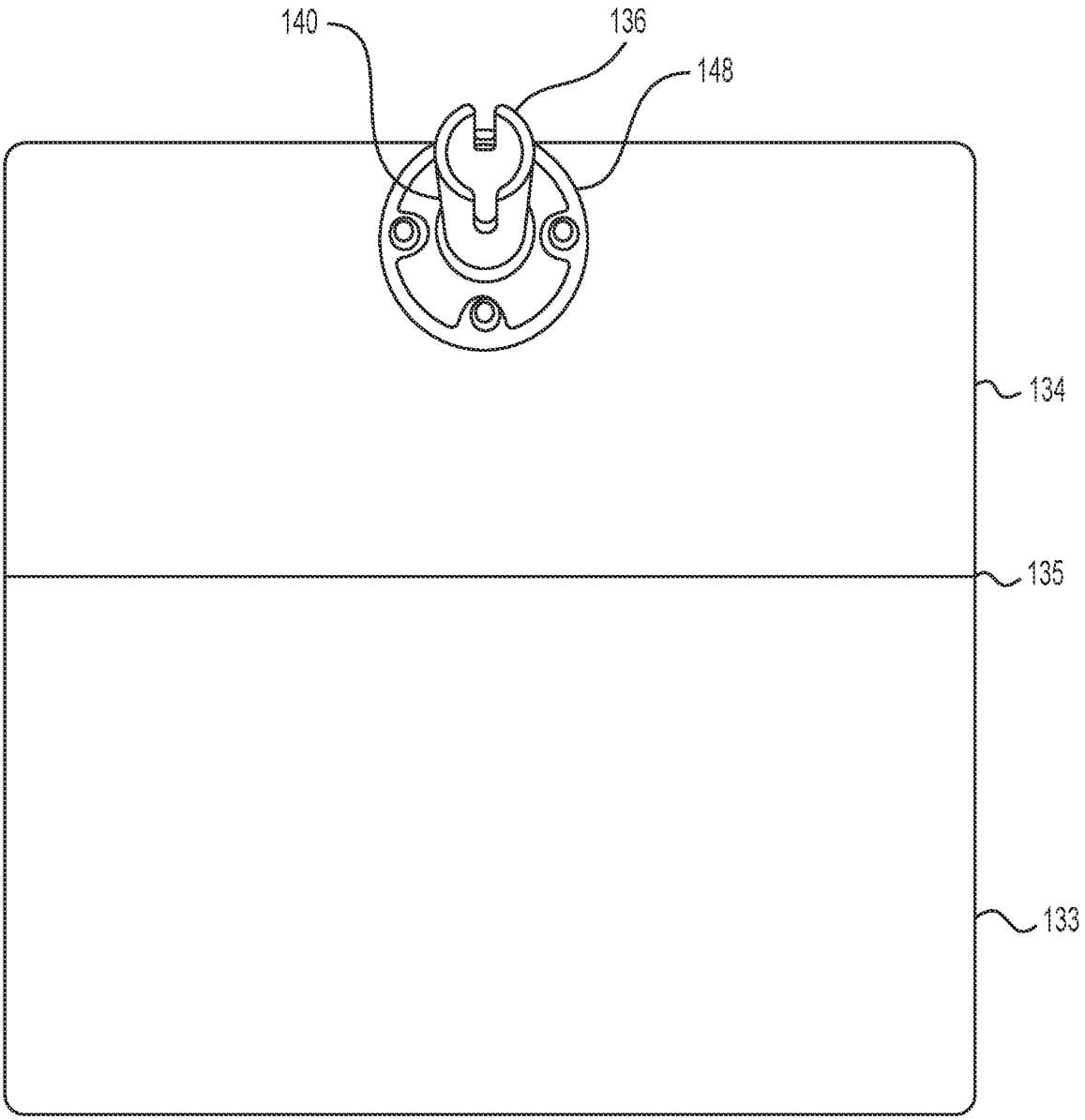
FIG. 4 is a top, schematic perspective view of an illustrative embodiment of base member and mounting prong of an illustrative embodiment of a basketball practice device.
Figure 5:
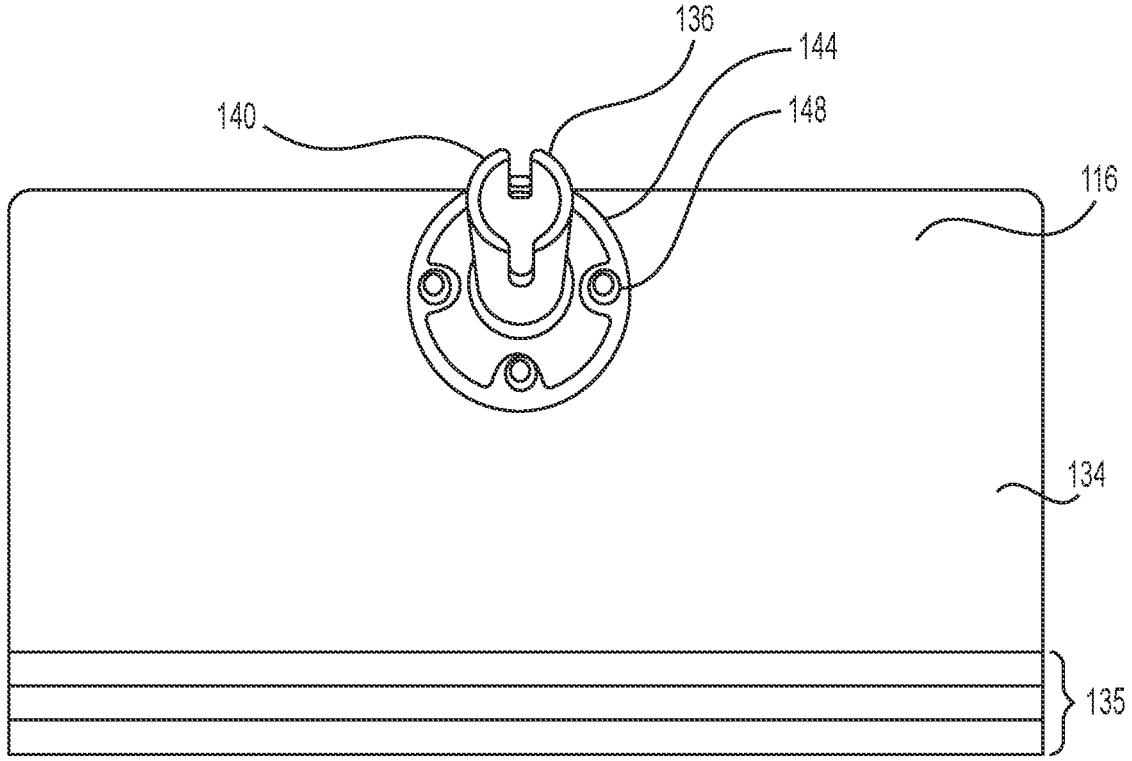
FIG. 5 is the base and mounting prong of FIG. 4 shown with a portion of the base disassembled.
Figure 6:
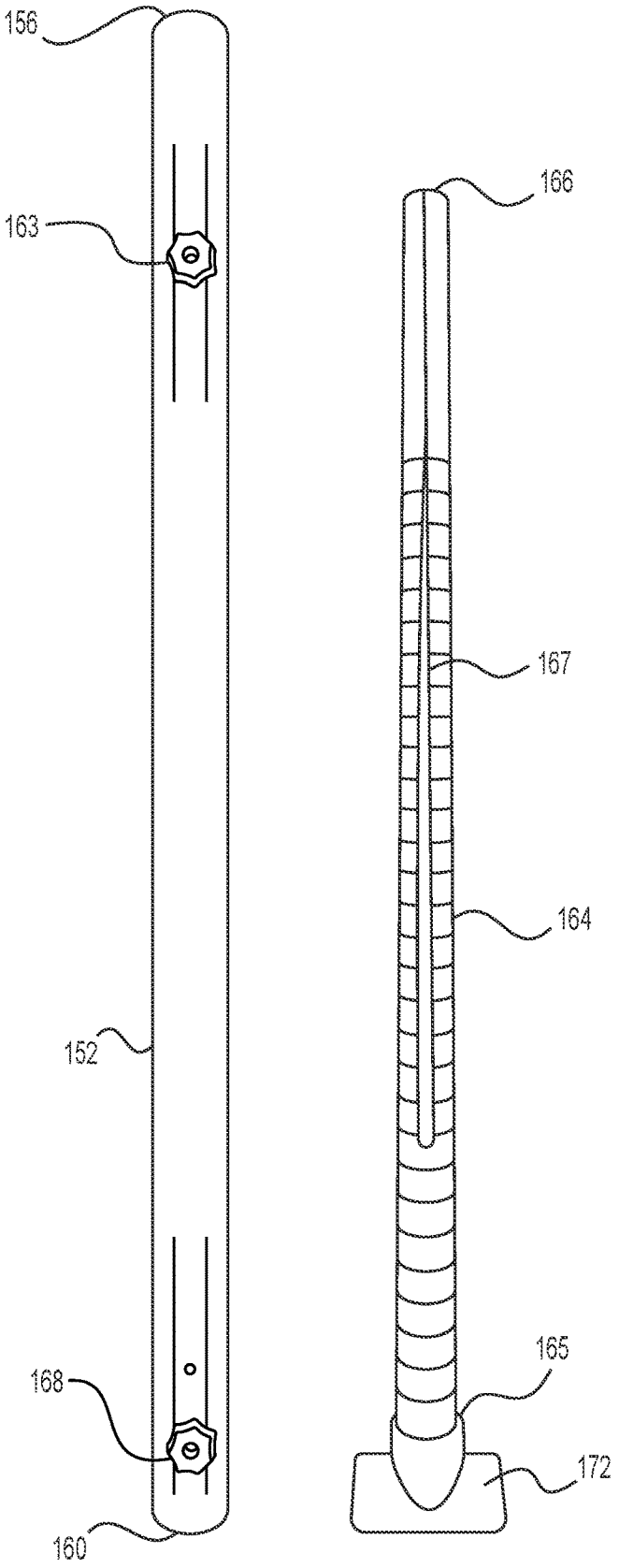
FIG. 6 is a schematic perspective view of an illustrative embodiment of a first vertical tube and a first telescoping member of an illustrative embodiment of a basketball practice device.
Figure 7:
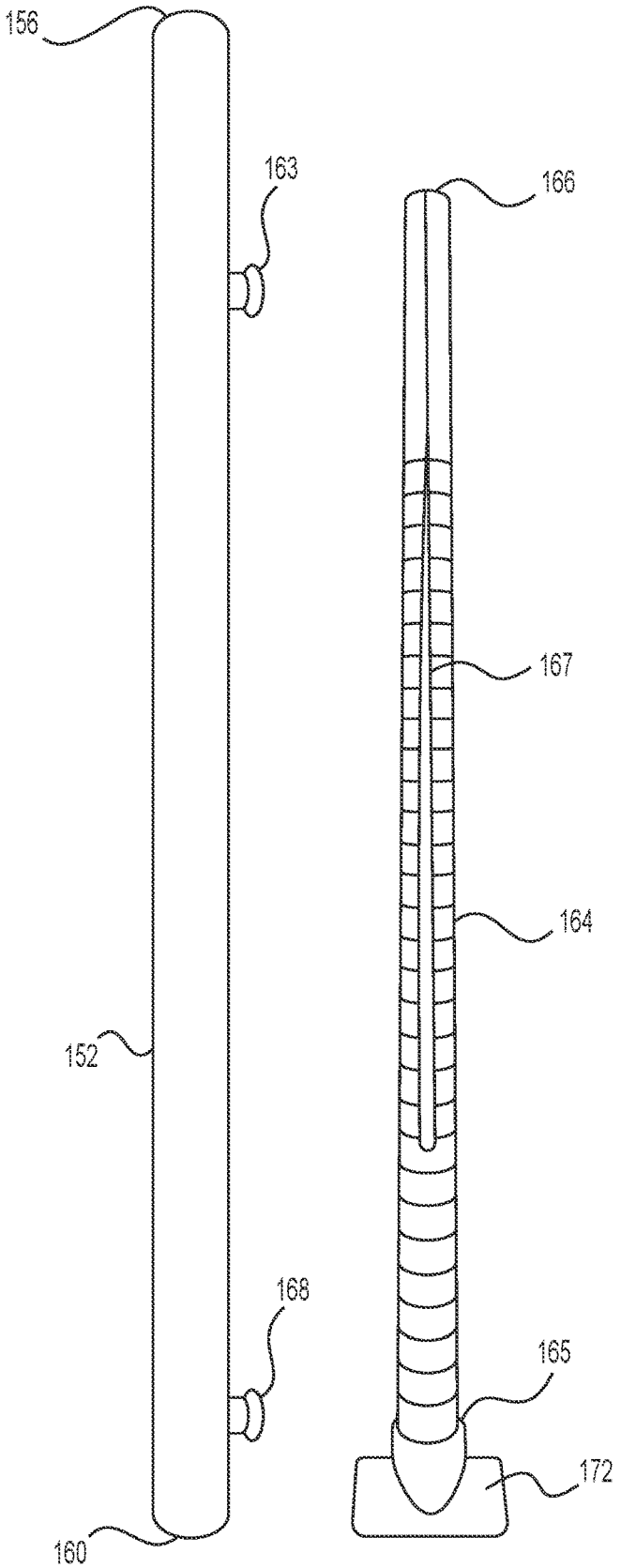
FIG. 7 is the same as FIG. 6 with the first vertical tube turned 90 degrees.
Figure 8:
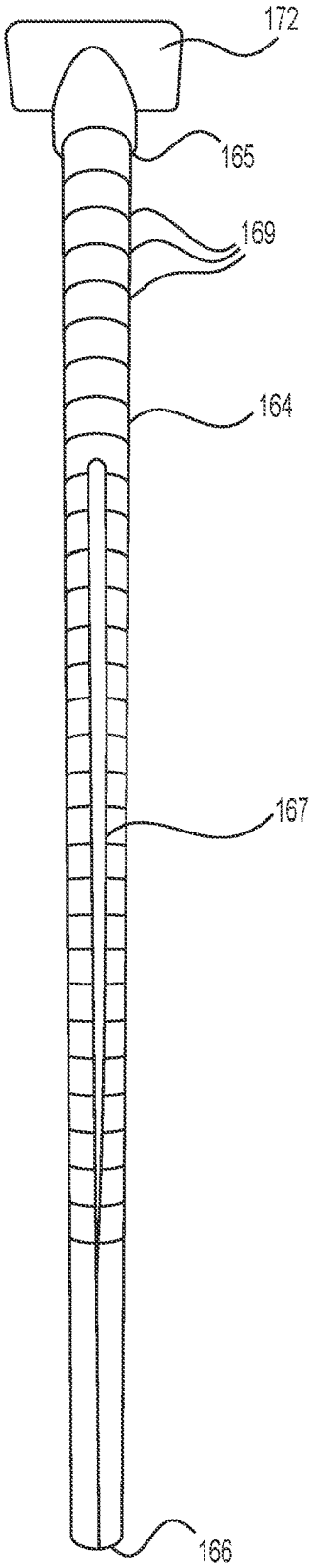
FIG. 8 is a schematic perspective view of an illustrative embodiment of the first vertical tube of FIGS. 6-7.

A mounting prong 136 or other securing device is coupled to the first side 120 of the base 116. The mounting prong 136 is shown best in FIGS. 4 and 5. The mounting prong 136 may have a vertical projection portion 140 that is coupled to a mounting base or flange 144 that is secured with fasteners 148 in this embodiment to the base member 116.

As shown clearly in FIGS. 1-3 and 6-7, the basketball practice device 104 includes a vertical member 150, which may include a first vertical tube 152 and a telescoping member 164. The first vertical tube 152 has a first open end 156 and a second open end 160 before assembly. The second open end 160 is sized and configured to mate with the mounting prong 136. The vertical tube 152 may have various slots, e.g., slot 162. Those skilled in the art will appreciate that in other embodiments the vertical tube 152 may be a rod and the mounting prong may be a tube for receiving an end of the rod.

The first vertical tube 152 or member may have a first fastener 163, e.g., wing nut, proximate the first end 156 for securing a first telescoping member 164 and may have a second fastener 168 proximate the second end 160 for securing the mounting prong 136, or securing base.

The first telescoping member 164 has a first end 165 and a second end 166. The second end 166 of the first telescoping member 164 is received by the first open end 156 of the first vertical tube 152. The basketball practice device 104 also has the first fastener or fastening means 163 proximate the first open end 156 of the first vertical tube 152 for selectively securing the first telescoping member 164 relative to the first vertical tube 152. The fastening means 163 may be a fastener (bolt, screw), a wing nut, latch, clamp, locking tabs, or ball and socket. The telescoping member 164 may have one or more slots 167 for flexibility. The telescoping member 164 may also have a plurality of measurement marking or visual indicia 169 to aid in adjusting the relative expansion and easily repeating arrangements. Likewise, the horizontal member 112 may have visual indicia to help measure place the vertical guides 200, 204, or guideposts.

Figure 9:
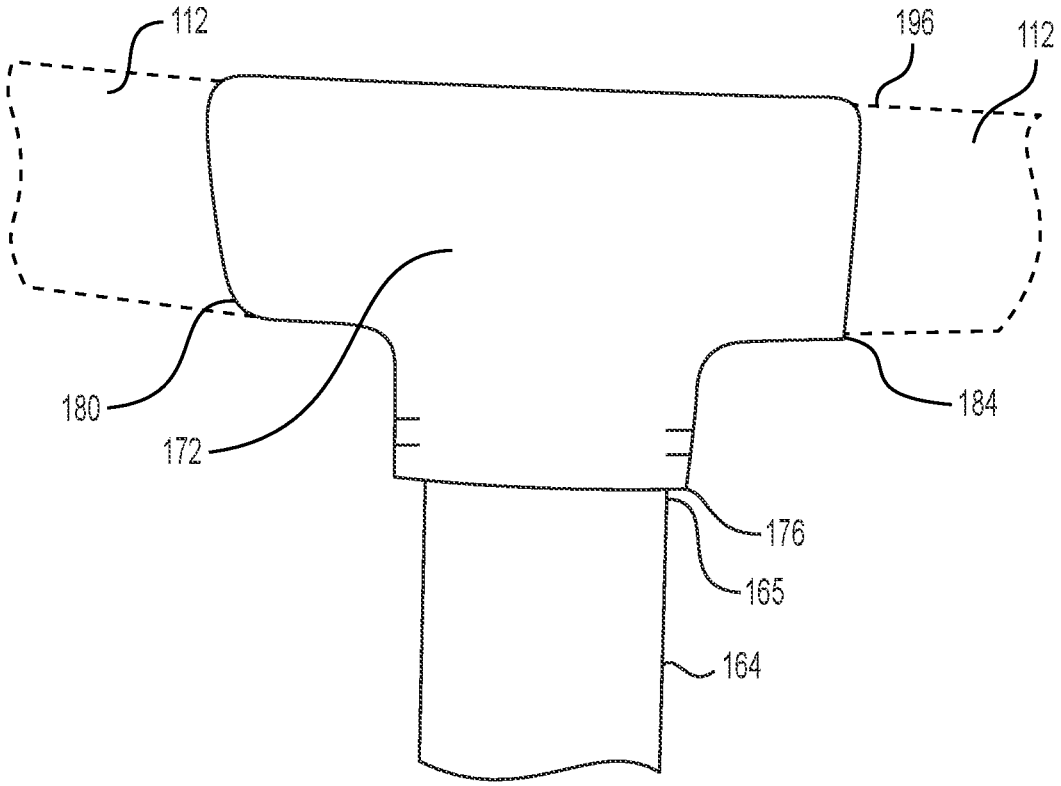
FIG. 9 is a schematic perspective view of an illustrative embodiment of a "T" joint member for use in an illustrative embodiment of a basketball practice device.

The basketball practice device 104 further includes a first T-joint member 172 coupled to the first end 165 of the first telescoping member 164 with a top of the "T" shape being most vertical when ready for use. As shown best in FIG. 9, the T-joint member 172 has a first opening 176 for receiving the first end 165 of the telescoping member 164, and has a second opening 180 and third opening 184 for receiving the horizontal member 112. The horizontal member 112 has a first end 188 (FIG. 3) and a second end 192 (FIG. 3). The horizontal member 112 also has an intermediate portion 196 between the first end 188 and second end 192. The T-joint 172 is coupled to the intermediate portion 196 of the horizontal member 112.

Figure 10:
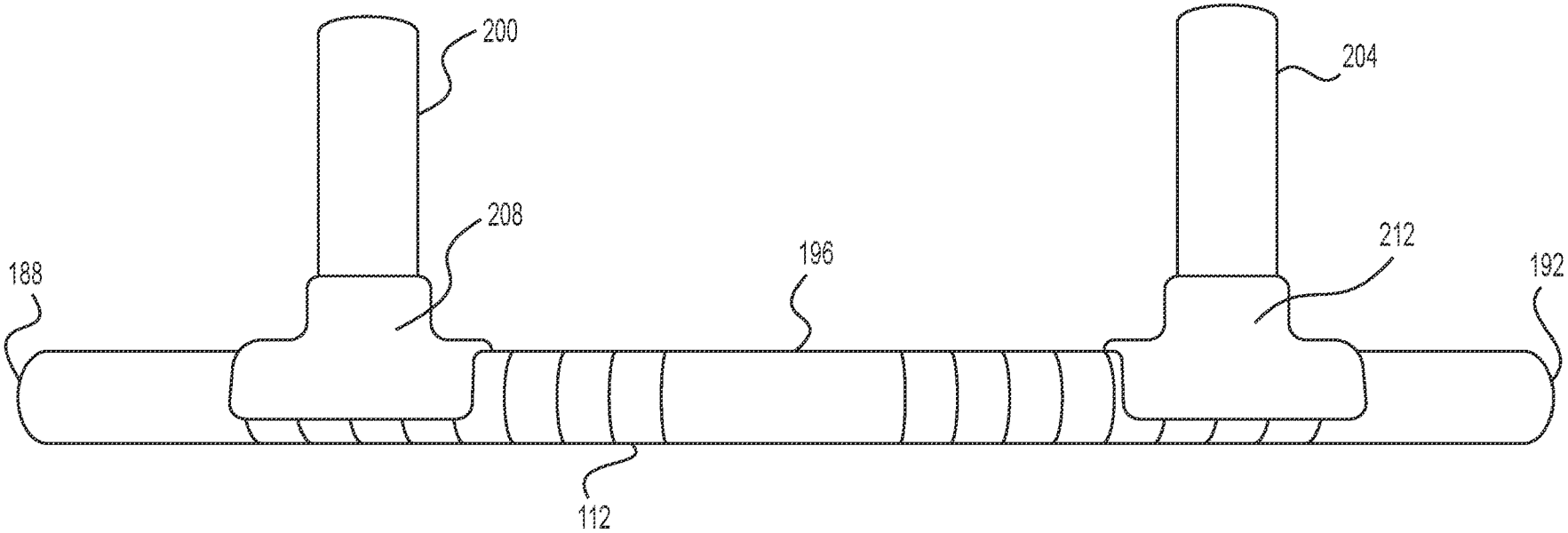
FIG. 10 is a schematic, front perspective view of an illustrative embodiment of a horizontal member and a plurality of vertical guideposts for use in an illustrative embodiment of a basketball practice device.
Figure 11:
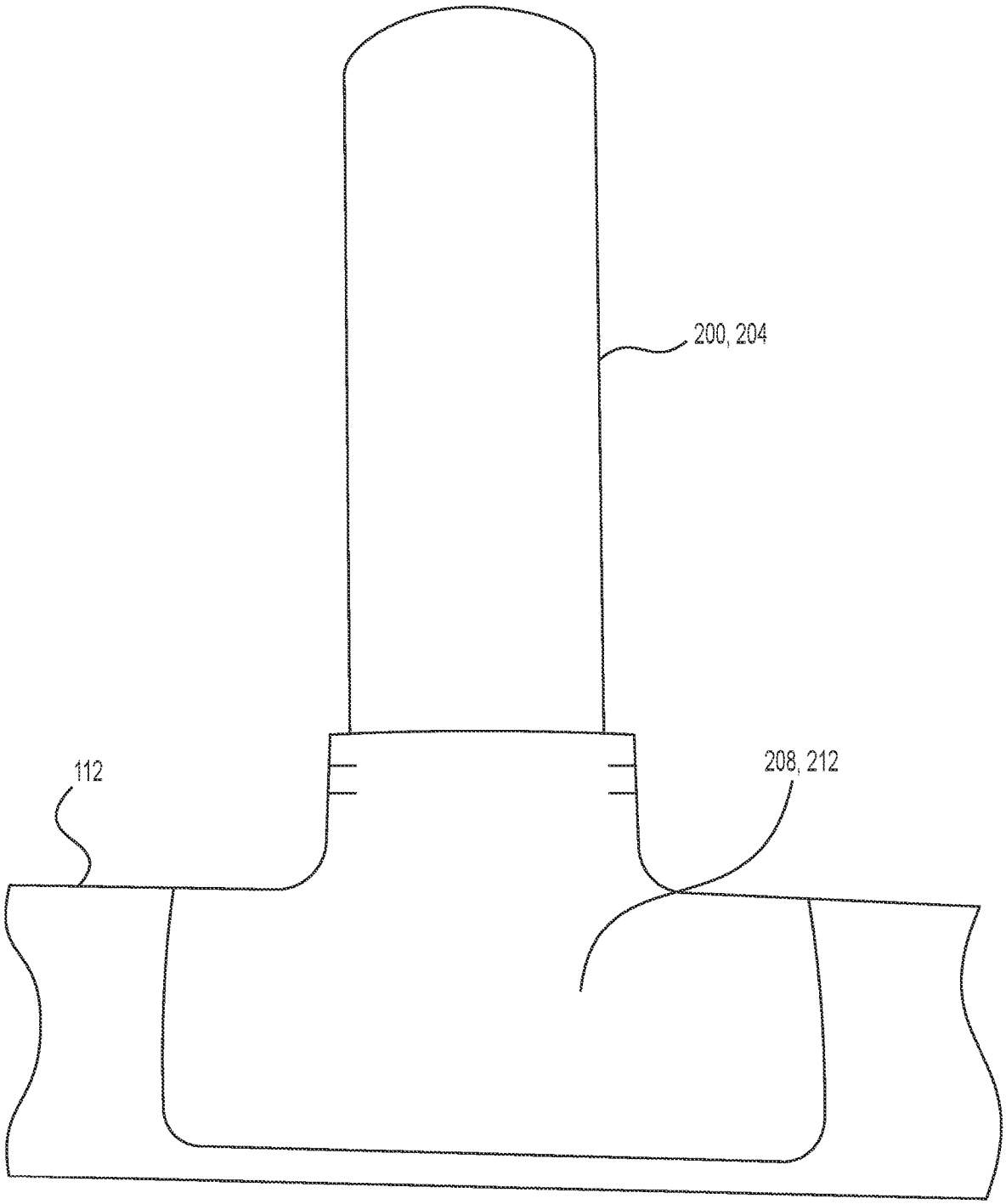
FIG. 11 is a schematic perspective view of an illustrative embodiment of a T-clamp for securing a vertical guidepost to a horizontal member as an aspect of an illustrative embodiment of a basketball practice device.

Referring primarily to FIGS. 3,10, and 11, the basketball practice device 194 may optionally include a plurality of vertical guideposts, e.g., a first vertical guidepost 200 and a second vertical guidepost 204. The first vertical guidepost 200 is coupled to the horizontal member 112 and extends upward therefrom. Likewise, the second vertical guidepost 204 is coupled to the horizontal member 112 and extends upward therefrom. While called "vertical" it should be understood that it may have some angle to it (1-20 degrees towards the user in some embodiments or to the side). A first T-clamp 208 may be used to releasably couple the first vertical guidepost 200 to the horizontal member 112. Likewise, a second T-clamp 212 may be used to releasably couple the second vertical guidepost 204 to the horizontal member 112. As is apparent, the vertical guide posts 200, 204 may be adjusted, or slide, to different positions along the horizontal member 112, i.e., along a sliding portion. Other fastening devices might be used in other embodiments. In one embodiment, the plurality of vertical guideposts extends vertically from the horizontal member by at least 2 inches.

Figure 12:
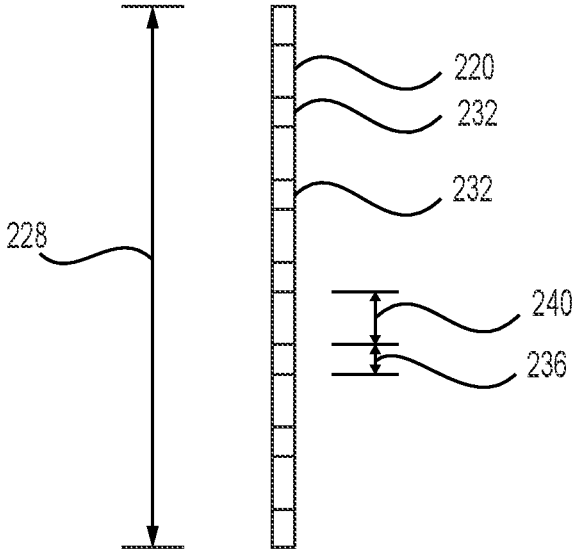
FIG. 12 is a schematic plan view of a rim target tape according to an illustrative embodiment.
Figure 13:
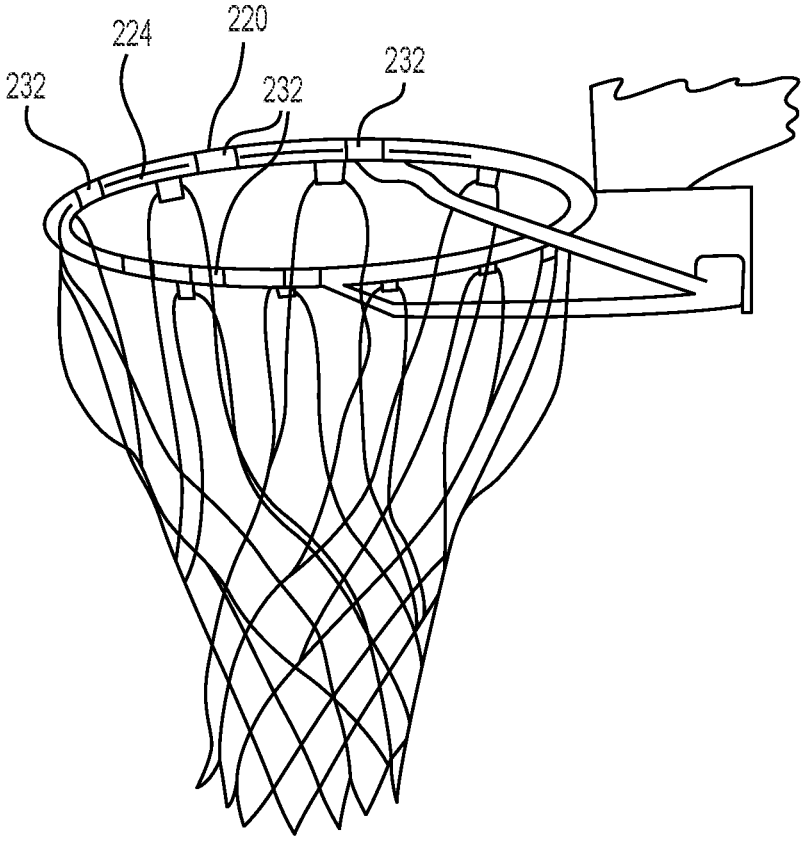
FIG. 13 is a schematic perspective view of the rim target tape of FIG. 12 applied to an illustrative rim.

Referring now primarily to FIGS. 12 and 13, an optional rim target tape 220 is presented for applying to a rim 224 of a basketball goal. As shown best in FIG. 12, the rim target tape 220 is a linear member having a length 228 sized and configured to go on all or a portion the rim 224. The rim target tape 220 has spaced targets 232. The targets 232 may have a longitudinal length 236 and be spaced by an interval 240. In some embodiments the length 236 is 2 inches and the intervals 240 may be 3⅜ inches. In other embodiments, the longitudinal length 236 may be in the range of 0.5 to 4.0 inches and the intervals 240 may be in the range 1.0-6.0 inches or any permutation thereof. Those skilled the art will appreciate that the dimensions may be varied in various applications. The targets 232 provide aiming targets for users.

In other embodiments, the targets 232 may be painted on the rim 224 by the manufacturer. In other embodiments, a tape backing, or carrier, may be provided that has taped targets 232 on the carrier that are properly spaced. The person assembling the basketball practice device 104 may use the carrier to position the targets 232 on the rim 224. Once lined up using the carrier, the targets 232 are removed and applied to the rim 224.

Figure 14:
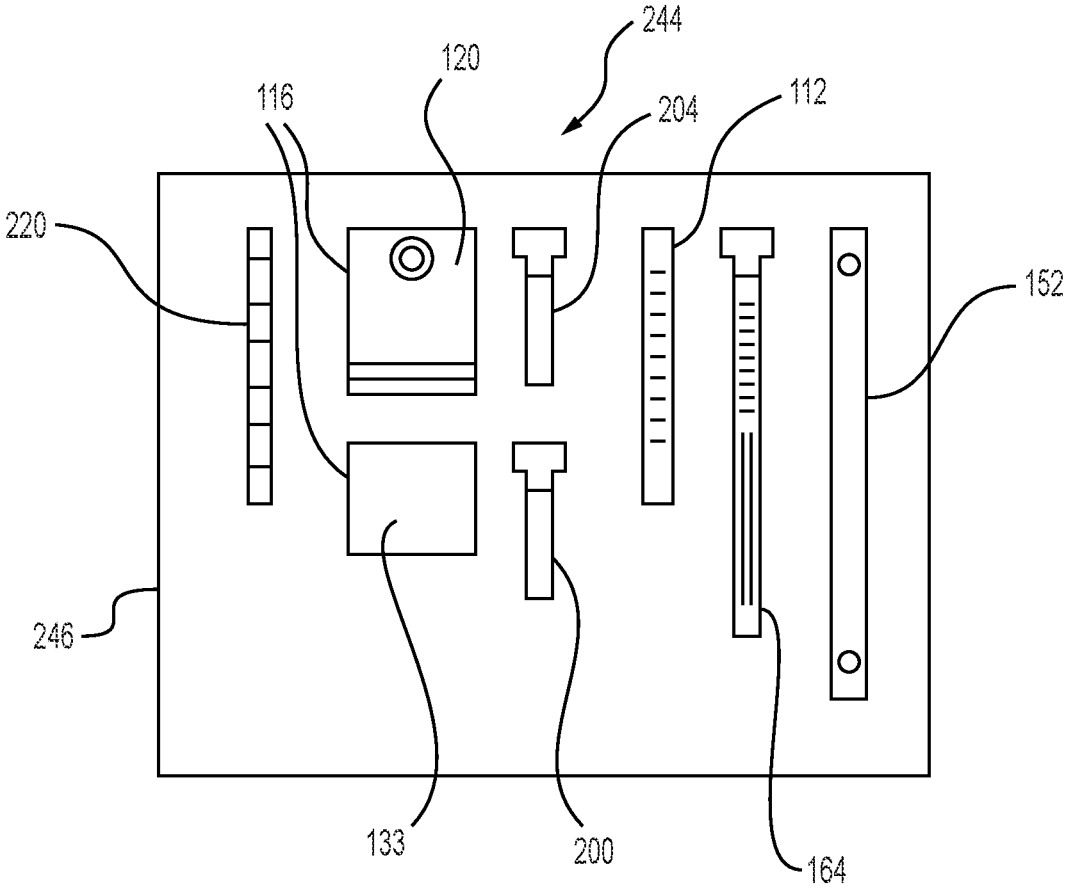
FIG. 14 is a schematic plan view of an illustrative embodiment of a basketball practice device kit.

Referring now primarily to FIG. 14, one should understand that the components referenced herein may be used as a kit 244 that comes ready for assembly as a basketball practice device 104. The kit 244 may be a box 246 or other container having the first vertical tube 152, the first telescoping member 164, the horizontal member 112, and the base 116, which may include the first base member 120 and second base member 133. The kit 244 may optionally include the first vertical guidepost 200 and second vertical guidepost 204. It 244 may further include the optional rim target tape 220. In another illustrative embodiment, the basketball practice device 104 comes pre-assembled.

According to an illustrative embodiment, a method of training a basketball player to shoot the basketball from over his or head is provided that involves placing a stand in front of the user that has a horizontal member that keeps the player from lowering his or her arms while shootings. The stand may be of the type described elsewhere herein as the basketball practice device 104.

There are many illustrative embodiments of the disclosure. Many have been referenced above and other examples now follow.

Example 1. A basketball practice device, the device comprising:

- a base member having a first side and a second side, wherein the first side is for receiving one or more feet of a user and the second side, which is opposes the first side, interfaces with a floor surface or ground;
- a mounting prong coupled to the first side of the base;
- a first vertical tube having a first open end and a second open end, wherein the second open end is sized and configured to mate with the mounting prong;
- a first telescoping member having a first end and a second end, wherein the second end of the first telescoping member is received by the first open end of the first vertical tube;
- a first fastening means proximate the first open end of the first vertical tube for selectively securing the second end of the first telescoping member relative to the first vertical tube;
- a first T-joint member coupled to the first end of the first telescoping member with a top of a "T" shape being most vertical; and
- a horizontal member having a first end and a second end, and having an intermediate portion between the first end and second end, and wherein the T-joint is coupled to the intermediate portion of the horizontal member.

Example 2. The basketball practice device of Example 1, further comprising a first vertical guidepost coupled to the horizontal member and extending upward therefrom, and a second vertical guidepost coupled to the horizontal member and extending upward therefrom.

Example 3: The basketball practice device of Example 1, further comprising a second fastener proximate the second end of the first vertical tube for securing the first vertical tube relative to the mounting prong.

Example 4. The same basketball practice device of Example 1 except the first telescopic member goes over the first vertical tube, which may be a rod.

Example 5. The same basketball practice device of Example 1 except the first vertical tube, which may be a rod, goes into the mounting prong.

Example 6. The same basketball practice device of Example 2, further comprising a first T-clamp and a second T-clamp for releasably coupling the first vertical guidepost to the horizontal member and the second vertical guidepost to the horizontal member, respectively.

Example 7. The basketball practice device of Example 1 further including a rim target tape.

Figure 15:
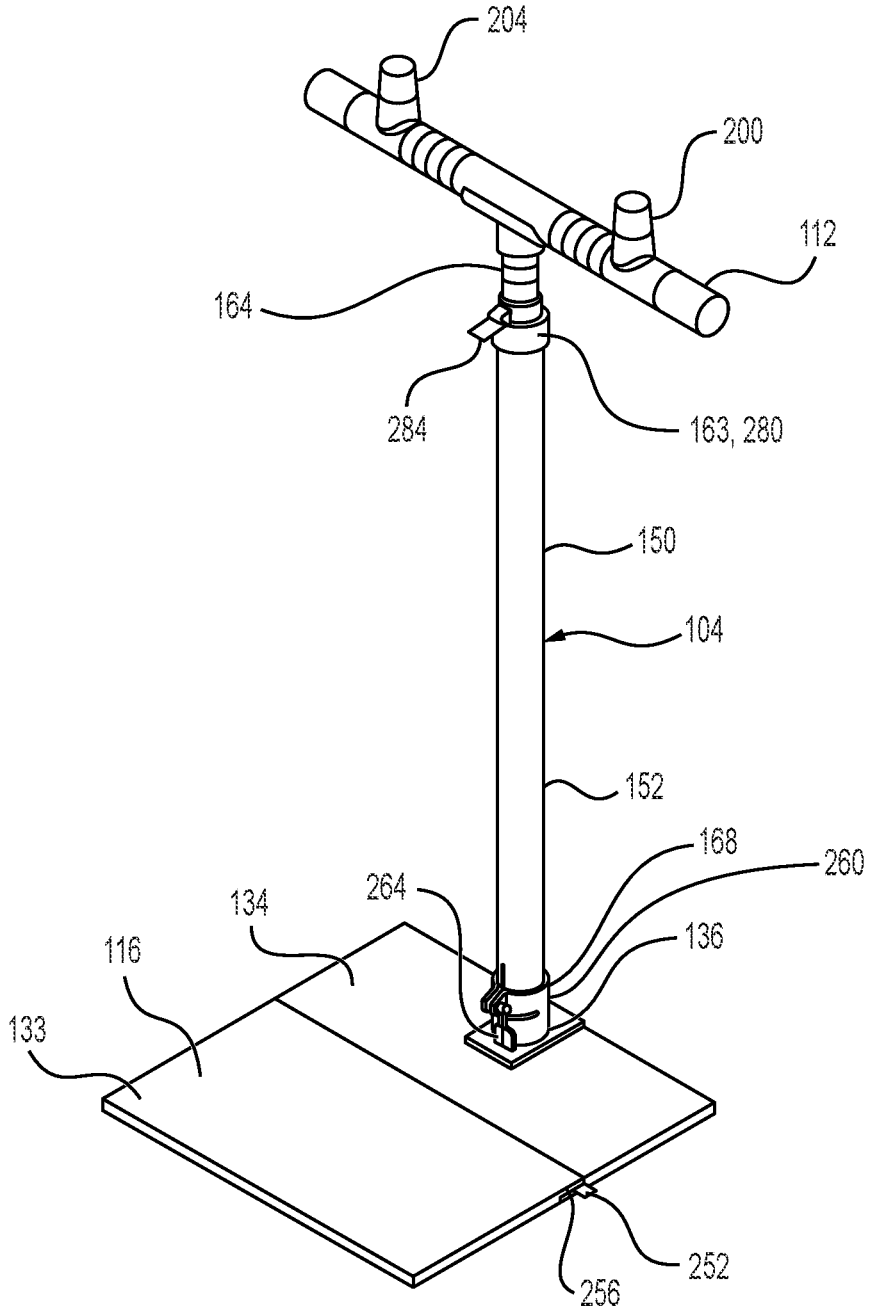
FIG. 15 is a schematic, perspective view of an illustrative embodiment of a basketball practice device.
Figure 16:
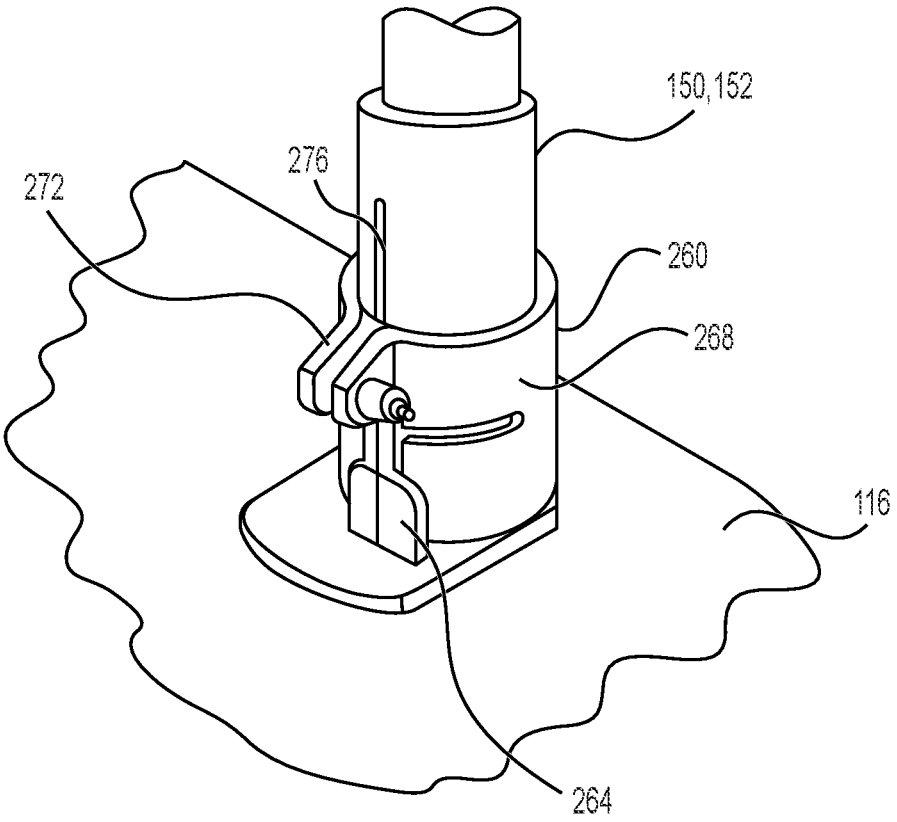
FIG. 16 is a schematic, perspective view of a portion of the basketball practice device of FIG. 15.

Referring now primarily to FIGS. 15 and 16, another illustrative embodiment of a basketball practice device 104 is presented. The basketball practice device 104 is analogous to those previously presented except for a few adjustments. The base member 116 is formed with a first panel 133 and a second panel 134 as previously presented, but are held together with a hook-and-loop material and a tab 252 secured under an overhang 256 of the first panel 133 that facilitates pulling the panels 133, 134 apart.

In addition, as shown clearly in FIG. 16, the fastener 168 used to couple the vertical member 150 to the mounting prong 136 is a base clamp 260, which includes a tightening screw or wing 264. As the screw or wing 265 is tightened it pulls a clamp body 268 closer together at its ends 272 and thereby compresses the tube 152, particularly given slot 276. Similarly, the fasten 163 may be another base clamp for releasably coupling the telescoping member 164 within a vertical tube 152 with tightening screw or wing. In addition, the interior of the vertical tube 152 or the exterior of the telescoping member 164 have a friction material, e.g., cork, on it. In one embodiment, the fastener comprises a base clamp with tightening screw.

Figure 17:
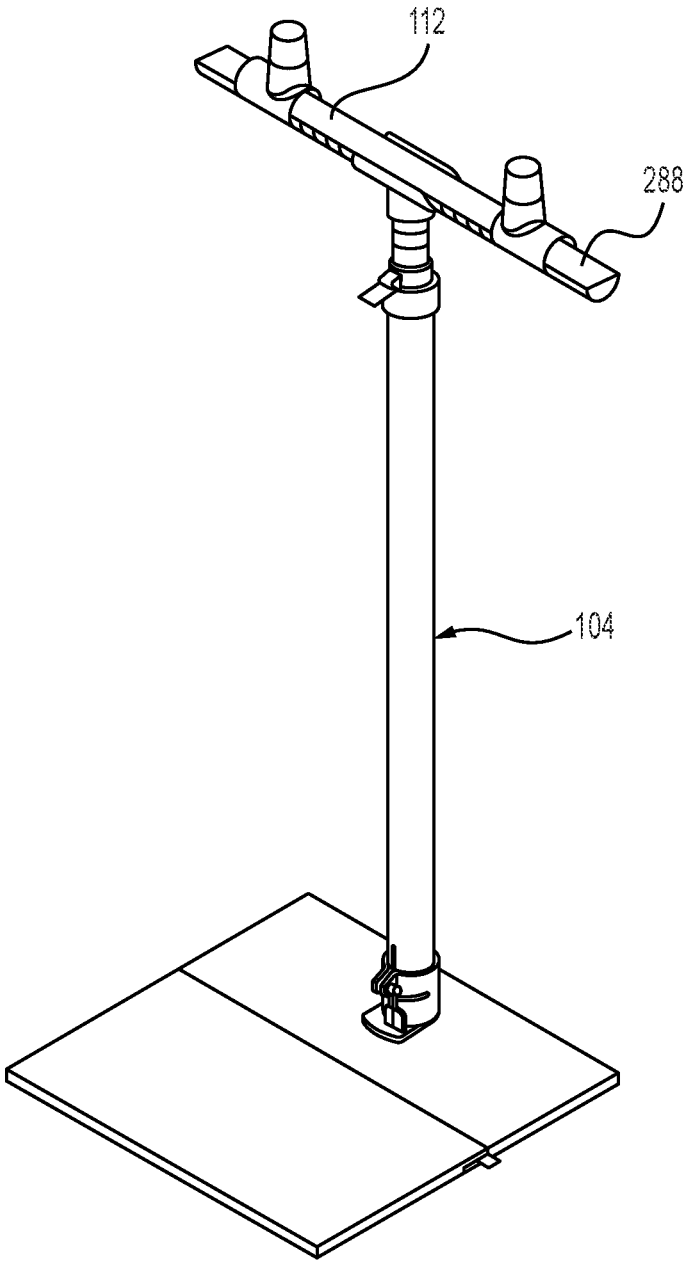
FIG. 17 is a schematic, perspective view of an illustrative embodiment of a basketball practice device.

Referring now primarily to FIG. 17, another illustrative embodiment of a basketball practice device 104 is presented. The basketball practice device 104 is analogous to those previously presented except the horizontal member 112 has a flat surface 288 on a top portion when assembled. The flat surface 288 accommodates a user resting their elbows (108 in FIG. 2) on the surface 288.

Figure 18:
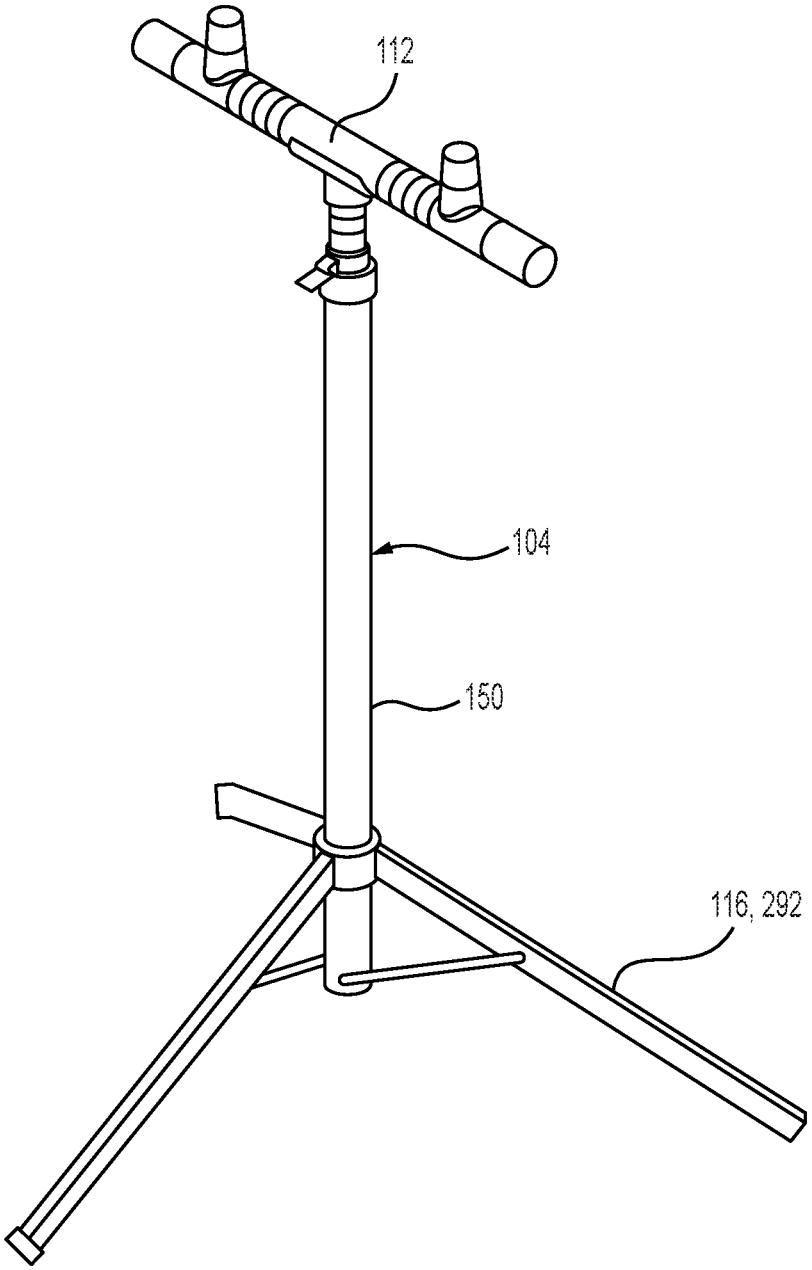
FIG. 18 is a schematic perspective view of another illustrative embodiment of a basketball practice device.

Referring now primarily to FIG. 18, another illustrative embodiment of a basketball practice device 104 is presented. The basketball practice device 104 is analogous to those previously presented except the base member 116 comprises a tripod 292 coupled to the vertical member 150 at a lower portion.

Those skilled in the art will appreciate that many permutations may be made while remaining within the scope of the disclosure.

Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in a connection to any one embodiment may also be applicable to any other embodiment.

What is claimed:

1. A basketball practice device, the device comprising:

a base member which when in an assembled and deployed position is supported by a surface or ground;

a vertical member releasably coupled to the base member and extending vertically at least three feet;

wherein the vertical member has a lower end coupled to the base member and an upper end;

a horizontal member coupled to the upper end of the vertical member;

wherein the horizontal member is at least two feet long;

a plurality of vertical guideposts spaced from one another and releasably coupled to the horizontal member;

a plurality of snap-on T-clamps, wherein the snap-on T-clamps releasably couple the plurality of vertical guideposts to the horizontal member;

wherein the base member comprises:

a substantially flat member having as a first side and a second side, wherein the first side is for receiving both feet of a user, and wherein the second side, which is opposes the first side, is against the surface or ground when in the assembled and deployed position;

wherein the base member comprises a first panel and a second panel, wherein the first panel has a first engaging ridge and the second panel has a second engaging ridge that is complementary to the first engaging ridge to releasably couple the first panel and the second panel when in the assembled and deployed position, and wherein the first engaging ridge and the second engaging ridge at least partially overlap vertically when in the assembled and deployed position;

wherein the plurality of vertical guideposts extends vertically from the horizontal member by at least 2 inches;

wherein the vertical member extends vertically between three and 6.5 feet;

wherein the vertical member comprises visual indicia indicating height information; and wherein the horizontal member is coupled to the vertical member by a T-joint member.

* * * * *